US006302120B1

(12) United States Patent
Kuo

(10) Patent No.: US 6,302,120 B1
(45) Date of Patent: Oct. 16, 2001

(54) COSMETIC CASE

(76) Inventor: Chen-Hui Kuo, No. 191, Lu Tung Rd., Ting Tsuo Li Lu Kang Township, Chang Hua Hsien (TW)

( * ) Notice: Subject to any disclaimer, the term of this patent is extended or adjusted under 35 U.S.C. 154(b) by 0 days.

(21) Appl. No.: 09/638,735

(22) Filed: Aug. 15, 2000

(51) Int. Cl.[7] ..... A45D 33/22
(52) U.S. Cl. ..... 132/295
(58) Field of Search ..... 132/294, 295, 132/296, 297, 300, 301, 314, 315, 316, 317, 293, 287, 286; D28/76, 78, 81, 82, 83, 84, 91; 206/823, 235, 581, 499, 501, 509; 220/291, DIG. 26

(56) References Cited

U.S. PATENT DOCUMENTS 1,455,432 * 5/1923 Dodson ..... 132/295
1,460,950 * 7/1923 Denney ..... 132/295
2,327,513 * 8/1943 Esterow ..... 132/295
3,476,123 * 11/1969 Flax ..... 132/295
4,807,773 * 2/1989 Tsai ..... 206/823

* cited by examiner

*Primary Examiner*—Gene Mancene
*Assistant Examiner*—Eduardo C. Robert
(74) *Attorney, Agent, or Firm*—Harrison & Egbert

(57) ABSTRACT

A cosmetic case is formed of an outer housing, and an inner housing which is rotatably disposed in a receiving space of the outer housing and is provided with a hollow interior for containing a variety of cosmetic products. The inner housing can be swiveled out of the receiving space of the outer housing to facilitate the using of the cosmetic products contained in the interior of the inner housing. The cosmetic case may be expanded in such a manner that is formed of a plurality of outer housings and inner housings equal in number to the outer housings. The outer housings are fitted together such that one of the outer housings is put on top of another one of the outer housings.

2 Claims, 5 Drawing Sheets

COSMETIC CASE

BACKGROUND OF THE INVENTION

1. Field of the Invention

The present invention relates generally to a cosmetic case, and more particularly to a modular cosmetic case.

2. Description of Related Art

The conventional cosmetic case is limited in design because it is provided with a limited space to hold the cosmetic products. The user of the conventional cosmetic case is often troubled or inconvenienced by the limited space which is insufficient to hold a variety of cosmetic products.

BRIEF SUMMARY OF THE INVENTION

The primary objective of the present invention is to provide a cosmetic case which is free from the drawback of the conventional cosmetic case described above.

In keeping with the principle of the present invention, the foregoing objective of the present invention is attained by a cosmetic case comprising an outer housing and an inner housing which is pivotally disposed in a receiving space of the outer housing. A variety of beauty products are kept in the inner housing in an organized manner. The inner housing can be swiveled out of the outer housing to facilitate the using of the beauty products. The cosmetic case of the present invention is modular in design.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

As shown in all drawings provided herewith, a cosmetic case of the preferred embodiment of the present invention comprises an outer housing 10 and an inner housing 20.

Figure 1:
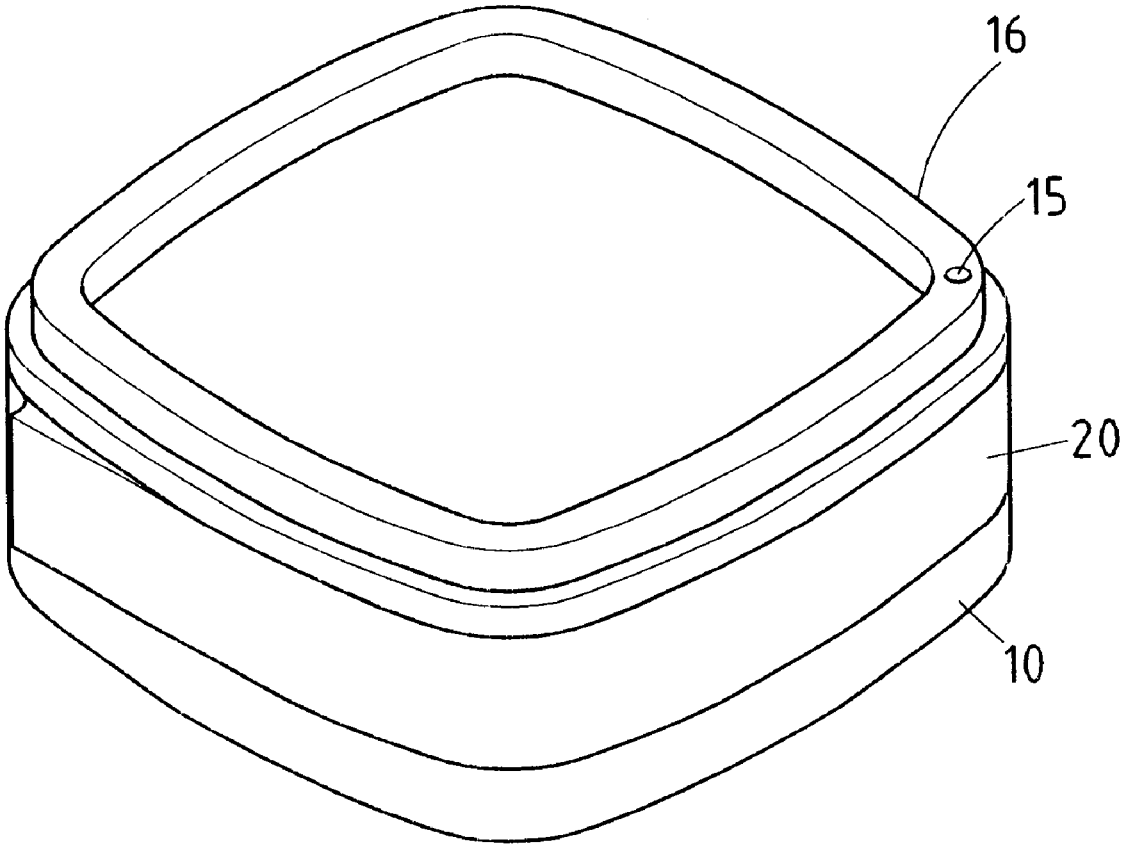
FIG. 1 shows a perspective view of the preferred embodiment of the present invention.
Figure 2:
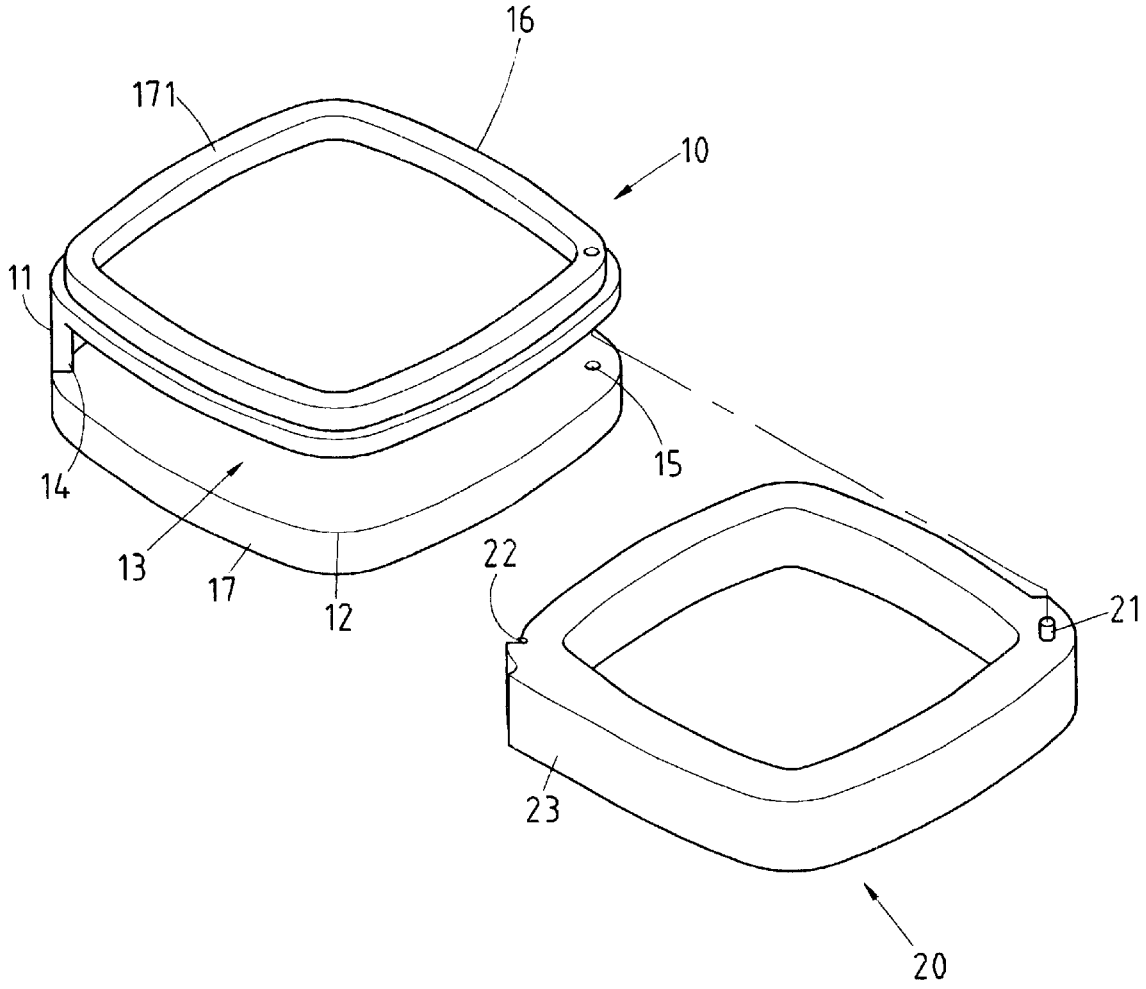
FIG. 2 shows an exploded view of the preferred embodiment of the present invention.
Figure 3:
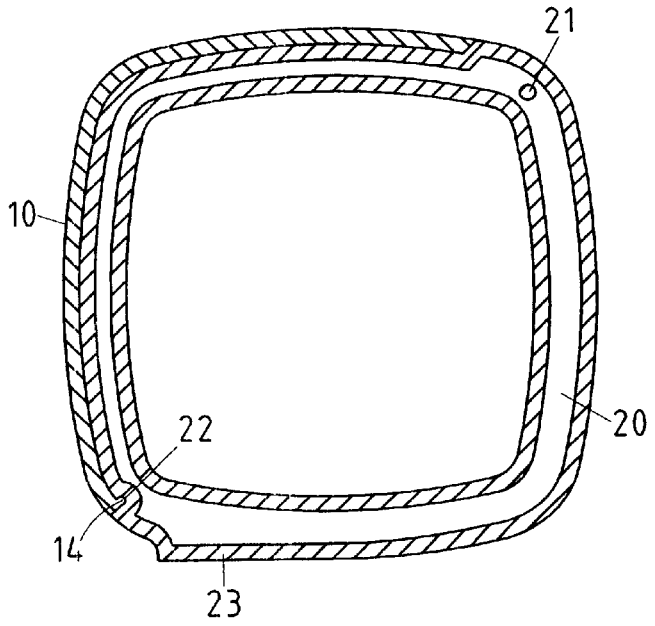
FIG. 3 shows a cross sectional view of the preferred embodiment of the present invention.
Figure 4:
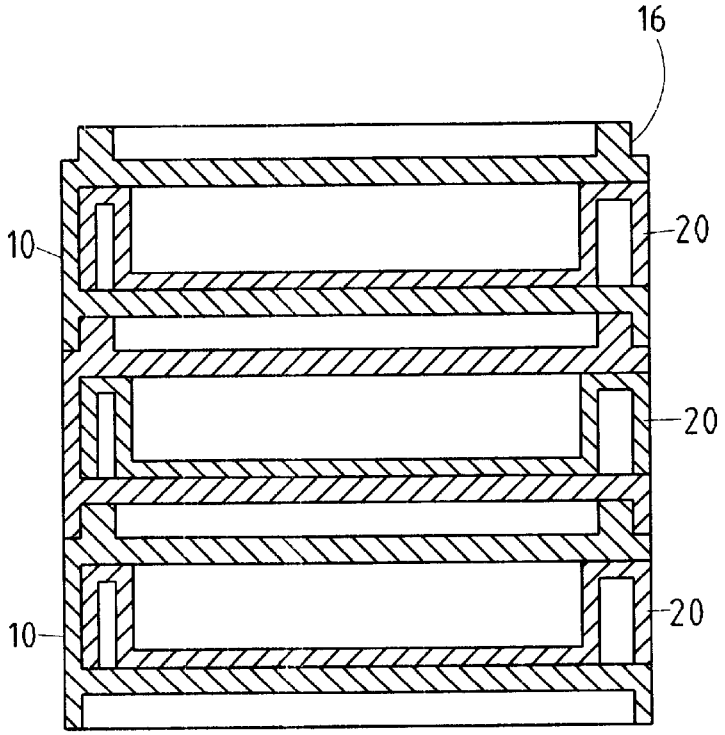
FIG. 4 shows a longitudinal sectional view of the preferred embodiment of the present invention.
Figure 5:
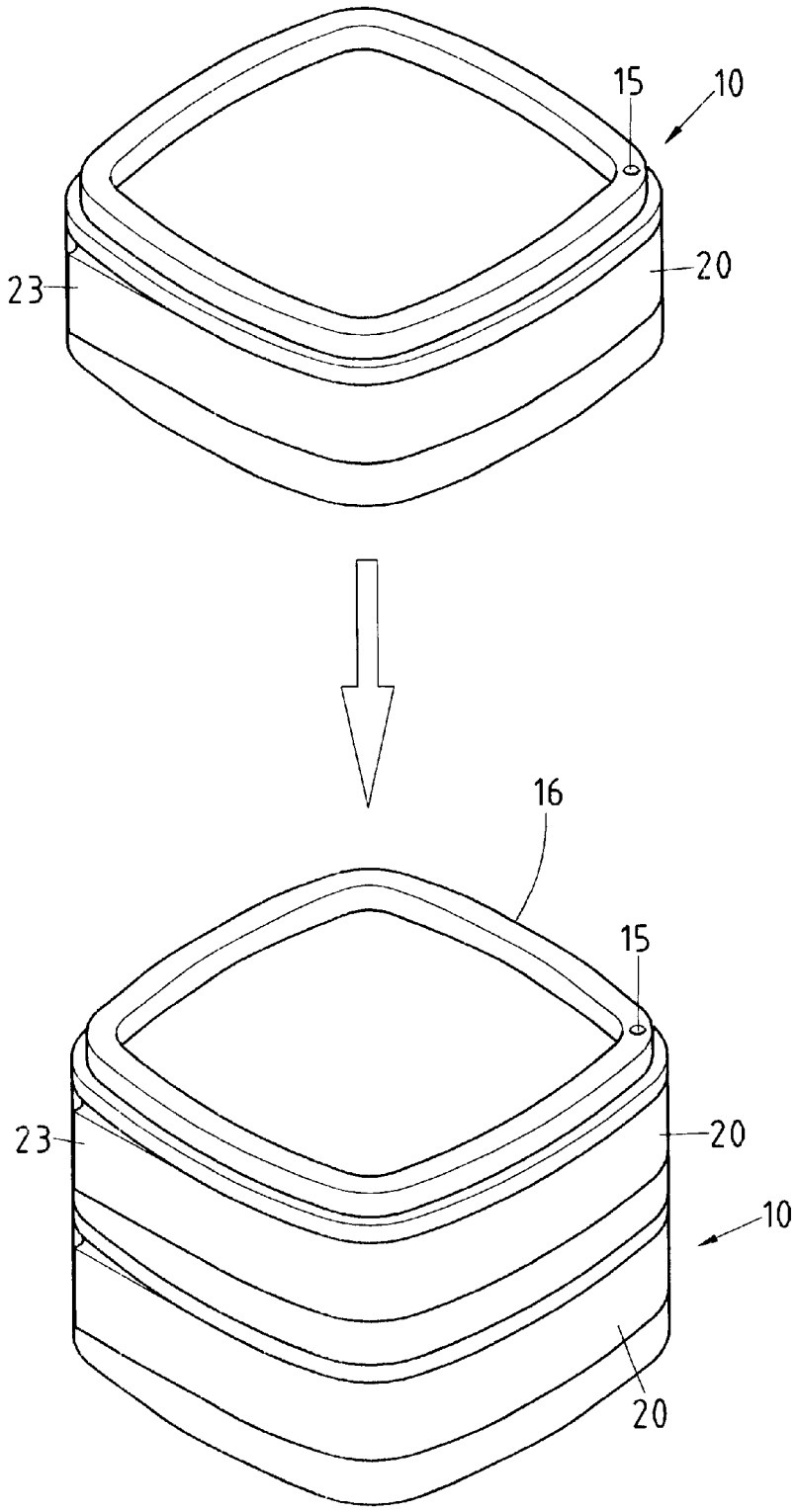
FIG. 5 shows a schematic view of a modular cosmetic case of the preferred embodiment of the present invention.
Figure 6:
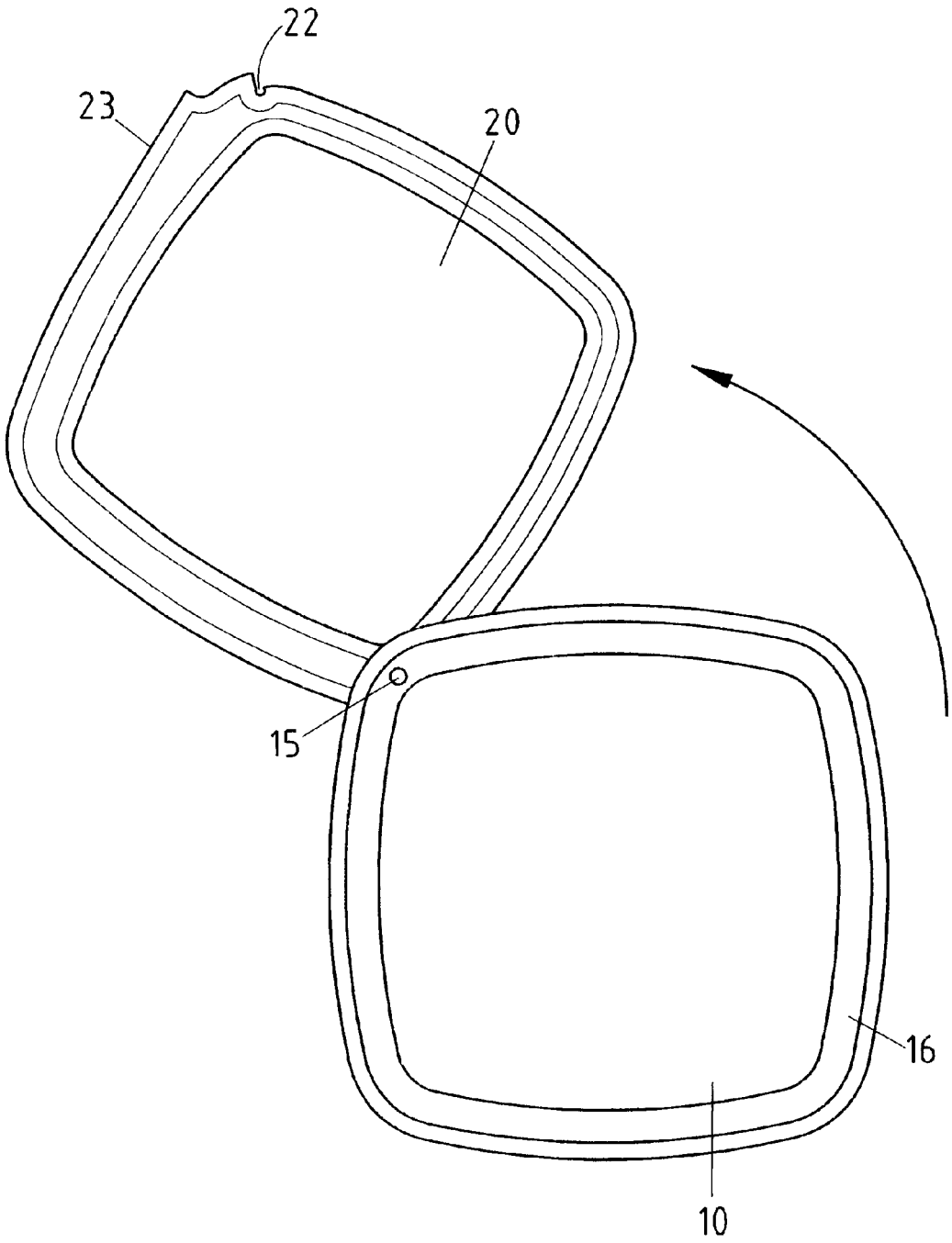
FIG. 6 shows a schematic view of the preferred embodiment of the present invention in use.

The outer housing 10 is formed of an upper wall 16, a lower wall 17, a side wall 11 connecting the upper wall 16 and the lower wall 17, a receiving space 13 formed between the upper wall 16 and the lower wall 17, and an opening 12 which is in fact an extension of the receiving space 13. The upper wall 16 is provided with a retaining protrusion 171 extending along the upper surface margin of the upper wall 16. The lower wall 17 is provided in the underside with a retaining groove (not shown in the drawings) for retaining the retaining protrusion 171 of the upper wall 16 of another outer housing 10. A plurality of the outer housings 10 can be joined together such that they are superimposed, as shown in FIGS. 4 and 5, and such that the retaining protrusion 171 of one outer housing 10 is snugly fitted into the retaining groove of the lower wall 17 of another outer housing 10. The side wall 11 is provided at a predetermined position of the inner side thereof with a retaining projection 14. The upper wall 16 of the outer housing 10 is provided at a predetermined position of the underside thereof with a swiveling recess 15.

The inner housing 20 corresponds in shape and size to the outer housing 10 and is provided with a hollow interior for holding a variety of cosmetic products. The inner housing 20 is provided at a predetermined position of the upper side of the side wall thereof with a swiveling projection 21 corresponding in location to the swiveling recess 15 of the outer housing 10. The inner housing 20 is further provided at a predetermined position of the outer side wall thereof with a grip portion 23. The inner housing 20 is also provided at a predetermined position of the outer side wall thereof with a retaining recess 22 corresponding in location to the retaining projection 14 of the side wall 11 of the outer housing 10. The inner housing 20 is rotatably received in the receiving space 13 of the outer housing 10 such that the swiveling projection 21 of the inner housing 20 is inserted into the swiveling recess 15 of the outer housing 10, and such that the retaining projection 14 of the outer housing 10 is received in the retaining recess 22 of the inner housing 20, and further that the inner housing 20 can be freely swiveled on the swiveling projection 21. When a person wants to gain access to the beauty products kept in the interior of the inner housing 20, the inner housing 20 is swiveled out of the outer housing 10 by holding the grip portion 23 of the inner housing 20.

The outer housing 10 and the inner housing 20 of the cosmetic case of the present invention are made of a transparent material.

I claim:

1. A cosmetic case comprising:

an outer housing having an upper wall and a lower wall and a side wall, said side wall connecting said upper wall to said lower wall, said outer housing having a receiving space formed between said upper wall and said lower wall, said outer housing having an opening in communication with said receiving space, said side wall having a retaining protrusion on an inner side thereof, said upper wall having a swiveling recess at an underside thereof, said upper wall having a retaining protrusion extending along an upper surface thereof, said lower wall having a retaining groove formed in an underside thereof, said retaining groove suitable for engaging a retaining protrusion on an outer housing of another cosmetic case; and an inner housing corresponding in size and shape to said outer housing, said inner housing having a hollow interior suitable for containing cosmetic products therein, said inner housing having a swiveling projection on a side wall thereof, said swiveling projection corresponding in location to said swiveling recess of said outer housing, said inner housing having a retaining recess formed on an outer side wall thereof, said retaining recess corresponding in location to said retaining projection of said outer housing, said inner housing having a grip portion formed in said outer side wall, said inner housing being rotatably received in said receiving space of said outer housing such that said swiveling projection is inserted into said swiveling recess of said outer housing, said retaining projection of said outer housing received in said retaining recess of said inner housing, said inner housing swivelable on said swiveling projection.

2. The cosmetic case as defined in claim 1 comprising another outer housing, the outer housing being fitted together such that said retaining protrusion of said outer housing is fitted into a retaining groove formed in said another outer housing.

* * * * *

US006302120C1

(12) EX PARTE REEXAMINATION CERTIFICATE (4994th)

United States Patent
Kuo

(10) Number: US 6,302,120 C1
(45) Certificate Issued: Oct. 5, 2004

(54) COSMETIC CASE

(75) Inventor: Chen-Hui Kuo, No. 191, Lu Tung Rd., Ting Tsuo Li Lu Kang Township, Chang Hua Hsien (TW)

(73) Assignee: Chen-Hui Kuo, Chang Hua Hsien (TW)

Reexamination Request:
No. 90/006,421, Oct. 24, 2002

Reexamination Certificate for:

| | |
|---|---|
| Patent No.: | **6,302,120** |
| Issued: | **Oct. 16, 2001** |
| Appl. No.: | **09/638,735** |
| Filed: | **Aug. 15, 2000** |

(51) Int. Cl.[7] ..... A45D 33/22
(52) U.S. Cl. ..... 132/295
(58) Field of Search ..... 132/294, 295, 132/296, 297, 300, 301, 314, 315, 316, 317, 293, 286, 287; D28/76, 78, 81–82, 83, 84, 91; 220/291, DIG. 26, 4.27; 206/823, 235, 581, 499, 501, 509

(56) References Cited

U.S. PATENT DOCUMENTS

| | | | | |
|---|---|---|---|---|
| 1,455,432 A | | 5/1923 | Dodson | |
| 1,460,950 A | | 7/1923 | Denney | |
| 3,392,868 A | * | 7/1968 | Pfrommer | 220/4.27 |
| 6,041,935 A | | 3/2000 | Yang | |

* cited by examiner

*Primary Examiner*—Todd E. Manahan

(57) ABSTRACT

A cosmetic case is formed of an outer housing, and an inner housing which is rotatably disposed in a receiving space of the outer housing and is provided with a hollow interior for containing a variety of cosmetic products. The inner housing can be swiveled out of the receiving space of the outer housing to facilitate the using of the cosmetic products contained in the interior of the inner housing. The cosmetic case may be expanded in such a manner that is formed of a plurality of outer housings and inner housings equal in number to the outer housings. The outer housings are fitted together such that one of the outer housings is put on top of another one of the outer housings.

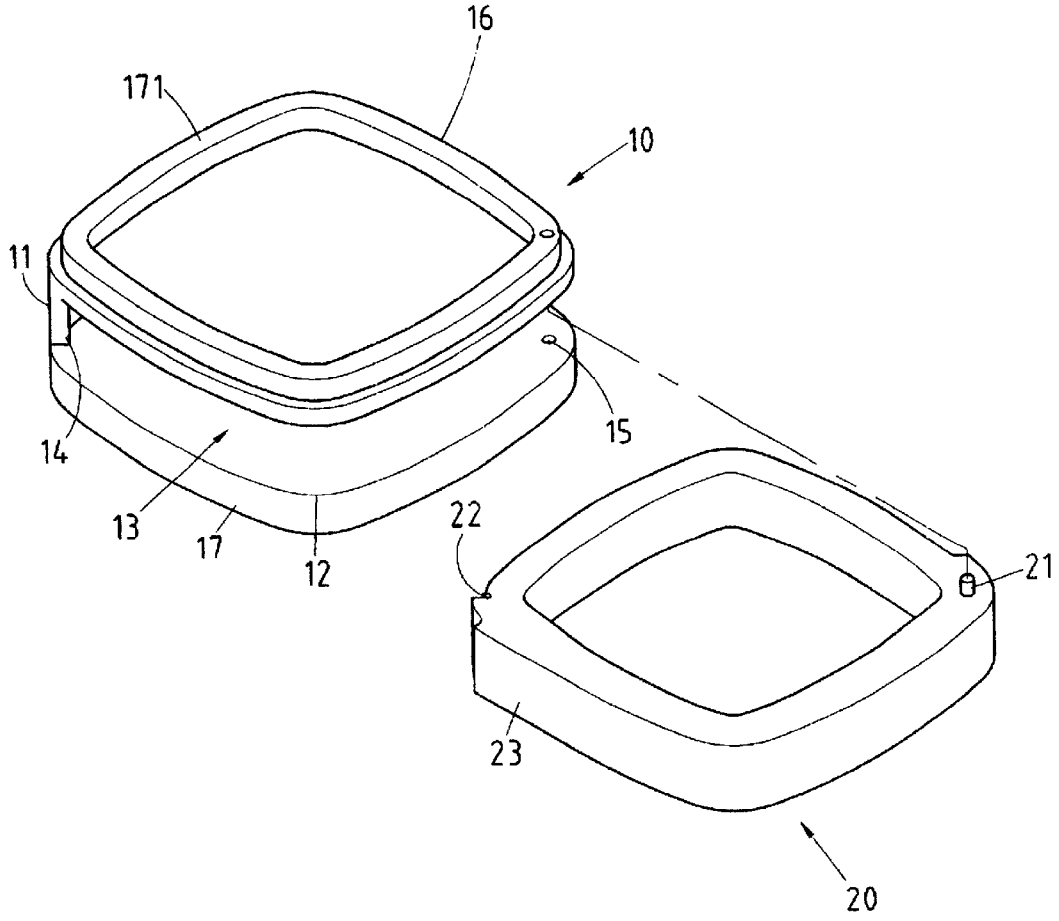

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1 and 2 are cancelled.

* * * * *